US011838739B2

(12) United States Patent
Taghizadeh et al.

(10) Patent No.: US 11,838,739 B2
(45) Date of Patent: Dec. 5, 2023

(54) DEVICE AND METHOD FOR OBTAINING A FIRST ORDER AMBISONIC SIGNAL

(71) Applicant: Huawei Technologies Co., Ltd., Shenzhen (CN)

(72) Inventors: Mohammad Taghizadeh, Munich (DE); Christof Faller, Uster (CH); Alexis Favrot, Uster (CH)

(73) Assignee: Huawei Technologies Co., Ltd., Shenzhen (CN)

( * ) Notice: Subject to any disclaimer, the term of this patent is extended or adjusted under 35 U.S.C. 154(b) by 253 days.

(21) Appl. No.: 17/495,359

(22) Filed: Oct. 6, 2021

(65) Prior Publication Data

US 2022/0030371 A1 Jan. 27, 2022

Related U.S. Application Data

(63) Continuation of application No. PCT/EP2019/059384, filed on Apr. 12, 2019.

(51) Int. Cl.
*H04S 3/02* (2006.01)
*G10L 19/008* (2013.01)
(Continued)

(52) U.S. Cl.
CPC ..... *H04S 3/02* (2013.01); *G10L 19/008* (2013.01); *H04R 1/326* (2013.01); *H04R 3/005* (2013.01);
(Continued)

(58) Field of Classification Search
CPC ... H04S 5/005; H04S 5/02; H04S 3/02; H04S 1/007; H04S 2400/15; H04S 2420/03; H04S 2420/11
See application file for complete search history.

(56) References Cited

U.S. PATENT DOCUMENTS 5,832,444 A 11/1998 Schmidt
7,233,833 B2 6/2007 Little
(Continued)

FOREIGN PATENT DOCUMENTS

WO 2016001357 A1 1/2016
WO 2019063877 A1 4/2019
WO WO-2019174725 A1 * 9/2019 ..... G10L 19/008

OTHER PUBLICATIONS

Faller "Conversion of Two Closely Spaced Omnidirectional Microphone Signals to an XY Stereo Signal," Audio Engineering Society 129th Convention, San Francisco, CA, USA, pp. 1-10 (Nov. 2010).
(Continued)

*Primary Examiner* — Kile O Blair
(74) *Attorney, Agent, or Firm* — Leydig, Voit & Mayer, Ltd.

(57) ABSTRACT

A device and method, respectively, obtain a first order ambisonic (FOA) signal from signals of multiple microphones, e.g., at least four or five directive microphones. The device and method determine a look direction of each microphone, and calculate a decoding matrix based on the determined look directions. The decoding matrix is a matrix suitable for decoding a FOA signal into the signals of the microphones. Further, the device and method invert the decoding matrix to obtain an encoding matrix, and encode the signals of the microphones based on the encoding matrix to obtain the FOA signal.

16 Claims, 5 Drawing Sheets

(51) Int. Cl.
*H04R 1/32* (2006.01)
*H04R 3/00* (2006.01)

(52) U.S. Cl.
CPC ..... *H04S 2400/11* (2013.01); *H04S 2420/11* (2013.01)

(56) References Cited

U.S. PATENT DOCUMENTS

| | | | | |
|---|---|---|---|---|
| 2011/0091048 | A1 | 4/2011 | Bai et al. | |
| 2018/0218740 | A1 | 8/2018 | Kleijn et al. | |
| 2019/0200155 | A1* | 6/2019 | Zhang ..... | H04R 29/005 |

OTHER PUBLICATIONS

Merimaa, "Applications of a 3-D Microphone Array," Audio Engineering Society 112th Convention, Munich, Germany, pp. 1-11 (May 2002).

Meyer et al., "A highly scalable spherical microphone array based on an orthonormal decomposition of the soundfield," 2002 IEEE International Conference on Acoustics, Speech, and Signal Processing, pp. 1781-1784, Institute of Electrical and Electronics Engineers, New York, New York (May 2002).

Olson "Gradient Microphones," The Journal of the Acoustical Society of America, vol. 17, No. 3, Total 8 pages (Jan. 1946).

Beranek "Acoustics," Total 255 pages, McGraw-Hill (1954).

Glasberg et al., "Derivation of auditory filter shapes from notched-noise data," Hearing Research, vol. 47, pp. 103-138, Elsevier Science Publishers B.V. (Biomedical Division) (1990).

Larsen et al., "Audio Bandwidth Extension: Application of Psychoacoustics, Signal Processing and Loudspeaker Design," John Wiley & Sons, Ltd, Total 313 pages (2004).

Moser et al., "Handbook of Engineering Acoustics," Total 703 pages, Springer-Verlag Berlin Heidelberg (2013).

Elko "Superdirectional Microphone Arrays," Acoustic Signal Processing for Telecommunication, Chapter 10, pp. 181-237, Springer Science+Business Media New York (2000).

* cited by examiner

DEVICE AND METHOD FOR OBTAINING A FIRST ORDER AMBISONIC SIGNAL

CROSS-REFERENCE TO RELATED APPLICATIONS

This application is a continuation of International Application No. PCT/EP2019/059384, filed on Apr. 12, 2019, the disclosure of which is hereby incorporated by reference in its entirety.

FIELD

The present disclosure relates to the audio recording of three dimensional (3D) sound, for instance, for virtual reality (VR) applications or surround sound. The disclosure thus relates to VR compatible audio formats, e.g., First Order Ambisonic (FOA) signals (also referred to as B-format). The disclosure further relates to a device and method for obtaining a FOA signal.

BACKGROUND

VR sound recording typically requires Ambisonics B-format to be captured with four first-order microphone capsules. To this end, professional audio microphones may either record A-format—to be then encoded into B-format by applying a four by four conversion matrix—or may record directly the Ambisonics B-format—for instance by using soundfield, like microphones.

However, in many consumer products, first-order microphones (or other directive microphones) are not suitable, since they have to lay in free-field to be operational. Instead, omnidirectional microphones are used in such products, and their signals are first mutually pre-processed to obtain at least four virtual first-order microphone signals to be then transformed into FOA.

In an exemplary method, a pair of two omnidirectional microphone signals can be converted into a first-order differential signal, yielding a virtual cardioid signal. Then, using a distribution of omnidirectional microphones, the resulting four differential signals can be encoded into B-format. However there are two main limitations with this method. A first limitation is related to the spectral defects at higher frequencies (given the spatial aliasing resulting from the microphones spacing), and a second limitation relates to the microphone placement constraints, due to design and hardware specifications, which prevent them looking in all directions.

The first limitation results from the spatial aliasing, which, by design, reduces the bandwidth to frequencies f in the range of:

$$f < \frac{c}{4 \cdot d_{mic}}, \tag{1}$$

In the above equation (1), c stands for the sound celerity, and $d_{mic}$ stands for the distance between a pair of two omnidirectional microphones.

Another exemplary method for generating FOA signals from omnidirectional microphones samples the soundfield using a dense enough distribution of microphones (e.g. the Eingenmike with 32 capsules). The sampled sound pressure signals are then converted to spherical harmonics, and then linearly combined to eventually generate FOA signals. The main limitation of this method is the required number of microphones. For consumer applications, with only few microphones available (commonly only up to 6), linear processing is too limited. This limitation leads to signal to noise ratio (SNR) issues at low frequencies, and again, to aliasing at high frequencies.

In summary, it is a challenging task to provide suitable audio recordings, in particular for VR applications, when using small and/or mobile devices such as phones, tablets, or on-board cameras. The non-consistent dimensions of many mobile devices (large screen/minimum thinness) restrict the possibility to record relevant sound in all directions and over all of the frequency bandwidth. Many constraints result directly from the device design: E.g. often only omnidirectional microphones can be used, while directive microphones are not suitable because they have to lie in free field. Further, microphone placement is often restricted to a limited number of possible positions on the device.

SUMMARY

In view of the above-mentioned challenges and limitations, embodiments of the present disclosure provide an improvement over the current methods. For example, the present disclosure provides a device and method that enable improved 3D audio recordings, which are suitable for VR applications, and can be performed with small and/or mobile devices. The device and method provide a FOA signal from multiple microphone signals. The use of directive microphones is possible. Further, the encoding of the multiple microphone sound signals into the FOA signal is more robust, in particular over a larger frequency bandwidth and over a larger set of directions.

The present disclosure provides, for example, a device and method for obtaining a FOA signal from signals of at least four directive microphones. An embodiment of the disclosure provides, for example, an overdetermined system, in which the device or method obtain the FOA signal from signals of at least five directive microphones.

Considering a system of M≥4 (possibly virtual) directive microphone signals, embodiments of the disclosure can generate a corresponding FOA signals successively by: deriving the look direction angles of the M directive microphones producing the microphone signals, and then computing a matrix representing how these directive microphones would be obtained for the FOA channels (W, X, Y, Z). This matrix is then inverted, e.g. using a pseudo-inverse algorithm, to obtain an inverted matrix, and the inverted matrix can be applied to the M microphone signals to generate the FOA channels.

A first aspect of the disclosure provides a device for obtaining a FOA signal from signals of at least four directive microphones, the device being configured to: determine a look direction of each microphone, calculate a decoding matrix based on the determined look directions, wherein the decoding matrix is suitable for decoding a FOA signal into the signals of the microphones, invert the decoding matrix to obtain an encoding matrix, and encode the signals of the microphones based on the encoding matrix to obtain the FOA signal.

Thus, the device of the first aspect allows obtaining the FOA signal from multiple microphone signals, wherein the use of directive microphones is possible. The device size can be reduced compared to the exemplary methods described above. Due to the calculation and use of the encoding matrix, the encoding of the multiple microphone sound signals into the FOA signal is also more robust, in particular over a larger frequency bandwidth and over a larger set of directions. Thus, the device of the first aspect enables improved recording of 3D audio suitable for VR applications and/or surround sound.

In an implementation form of the first aspect, the at least four directive microphones are five directive microphones or more.

In this implementation form, the device of the first aspect and the microphones provide an overdetermined system of M>4 directive microphone signals. This leads to even more accurate directional responses, and thus a more accurate FOA signal.

In an implementation form of the first aspect, the device comprises the at least four directive microphones, in particular comprises at least four first-order directive microphones.

Thus, limitations of the exemplary methods mentioned above are overcome, and directive microphones can be used in the device. The device can be reduced in size.

In an implementation form of the first aspect, at least one of the microphones is a virtual directive microphone, in particular based on at least two omnidirectional microphones.

In an implementation form of the first aspect, the device is further configured to determine the look direction of the virtual directive microphone based on an orientation of the at least two omnidirectional microphones.

Thus, an alternative to the used of directive microphones is provided. It is also possible to have directive microphones and omnidirectional microphones, of which the device receives signals, or which are part of the device.

In an implementation form of the first aspect, the look direction of a microphone is based on an azimuth angle and an elevation angle of that microphone.

In an implementation form of the first aspect, the decoding matrix is a B-format decoding matrix.

In an implementation form of the first aspect, the device is further configured to invert the decoding matrix using a pseudo-inverse algorithm.

In an implementation form of the first aspect, the device is further configured to perform a Direction of Arrival (DOA) estimation based on the FOA signal.

In an implementation form of the first aspect, the FOA signal comprises four FOA channels.

In an implementation form of the first aspect, the device is a mobile device.

For instance, the device may be a mobile phone, smartphone, laptop, tablet, camera, on-board camera or similar device. The device can have a larger screen and/or can be fabricated thinner than a device working with an exemplary method described above.

A second aspect of the disclosure provides a mobile device, particularly a smartphone, tablet or camera, including the device according to the first aspect or any of its implementation forms.

The mobile device enjoys all advantages and technical effects described above for the device of the first aspect.

A third aspect of the disclosure provides a method for obtaining a FOA signal from signals of at least four directive microphones, the method comprising: determining a look direction of each microphone, calculating a decoding matrix based on the determined look directions, wherein the decoding matrix is suitable for decoding a FOA signal into the signals of the microphones, inverting the decoding matrix to obtain an encoding matrix, and encoding the signals of the microphones based on the encoding matrix to obtain the FOA signal.

In an implementation form of the third aspect, the method is performed by or in a mobile device.

In an implementation form of the third aspect, the at least four directive microphones are five directive microphones or more.

In an implementation form of the third aspect, the at least four directive microphones comprise at least four first-order directive microphones.

In an implementation form of the third aspect, at least one of the microphones is a virtual directive microphone, in particular based on at least two omnidirectional microphones.

In an implementation form of the third aspect, the method further comprises: determining the look direction of the virtual directive microphone based on an orientation of the at least two omnidirectional microphones.

In an implementation form of the third aspect, the look direction of a microphone is based on an azimuth angle and an elevation angle of that microphone.

In an implementation form of the third aspect, the decoding matrix is a B-format decoding matrix.

In an implementation form of the third aspect, the method further comprises: inverting the decoding matrix using a pseudo-inverse algorithm.

In an implementation form of the third aspect, the method further comprises: performing a DOA estimation based on the FOA signal.

In an implementation form of the third aspect, the FOA signal comprises four FOA channels.

Accordingly, the method of the third aspect and its implementation forms achieve the same advantages and technical effects as described above for the device of the first aspect and its respective implementation forms, in particular because the method can be performed by the device of the first aspect.

A fourth aspect of the disclosure provides a computer program product comprising a program code for controlling a device according to the first aspect or any of its implementation forms, or for carrying out, when implemented on a processor, the method according to the third aspect or any of its implementation forms.

Thus, all advantages and technical effects described above for the device of the first aspect and method of the third aspect can be achieved.

It has to be noted that all devices, elements, units and means described in the present application could be implemented in the software or hardware elements or any kind of combination thereof. All steps which are performed by the various entities described in the present application as well as the functionalities described to be performed by the various entities are intended to mean that the respective entity is adapted to or configured to perform the respective steps and functionalities. Even if, in the following description of exemplary embodiments, a specific functionality or step to be performed by external entities is not reflected in the description of a specific detailed element of that entity which performs that specific step or functionality, it should be clear for a skilled person that these methods and functionalities can be implemented in respective software or hardware elements, or any kind of combination thereof.

BRIEF DESCRIPTION OF DRAWINGS

The above described aspects and implementation forms of the present disclosure will be explained in the following description of exemplary embodiments in relation to the enclosed drawings, in which.

DETAILED DESCRIPTION

Figure 1:
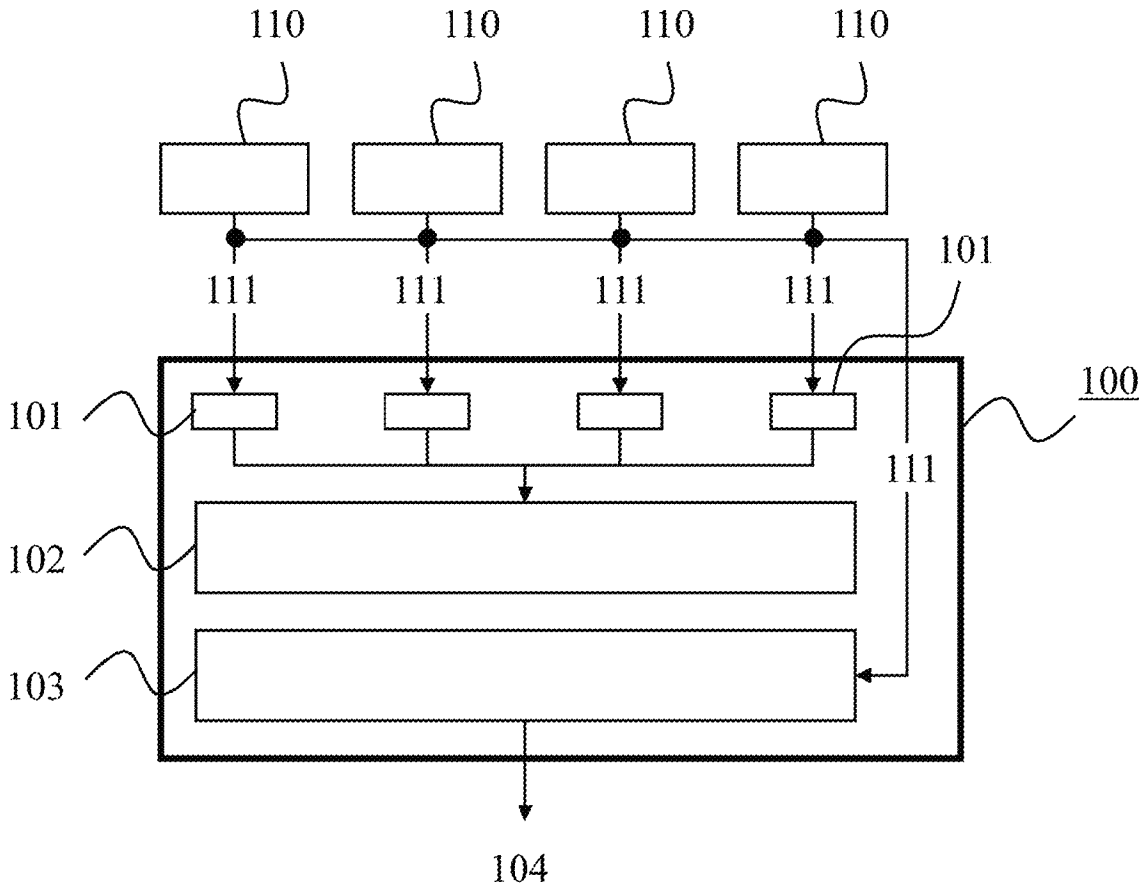
FIG. 1 shows a device for obtaining a FOA signal from signals of at least four directive microphones according to an embodiment of the disclosure.

FIG. 1 shows a device 100 according to an embodiment of the disclosure. The device 100 may comprise processing circuitry configured to perform, conduct or initiate the various operations of the device 100 described herein. The processing circuitry may comprise hardware and software. The hardware may comprise analog circuitry or digital circuitry, or both analog and digital circuitry. The digital circuitry may comprise components such as application-specific integrated circuits (ASICs), field-programmable arrays (FPGAs), digital signal processors (DSPs), or multi-purpose processors. In one embodiment, the processing circuitry comprises one or more processors and a non-transitory memory connected to the one or more processors. The non-transitory memory may carry executable program code which, when executed by the one or more processors, causes the device 100 to perform, conduct or initiate the operations or methods described herein.

The device 100 is configured to obtain a FOA signal 104 from signals 111 of at least four directive microphones 110. FIG. 1 exemplarily illustrates a scenario with four directive microphones, which may also be four virtual directive microphones (e.g., the sound may actually be captured by omnidirectional microphones). The device 100 may be a small and/or mobile device, or may be included in such a mobile device. The mobile device may, for example, be a smartphone, tablet, or camera.

The device 100 is configured to determine a look direction 101 of each directive microphone 110, e.g. based on the respective microphone signals 111. The look direction 101 of a directive microphone 110 may be derived based on an azimuth angle and an elevation angle of that microphone or based on an orientation of at least two omnidirectional microphones (in case of a virtual directive microphone 110).

The device 100 is further configured to calculate a decoding matrix 102 based on the determined look directions 101 of the microphones 110, wherein the decoding matrix 102 is a matrix that is suitable for decoding a FOA signal into the microphone signals 111 of the microphones 110. That is, the decoding matrix 102 is such that it could be used to generate/recover the microphone signals 111 from a FOA signal.

The device 100 is further configured to invert the decoding matrix 102 to obtain an encoding matrix 103, and to then encode the signals 111 of the microphones 110 based on the obtained encoding matrix 103 to generate the FOA signal 104. The FOA signal 104 may then be output, or may be used to obtain a DOA estimate for the microphone signals 111.

Figure 2:
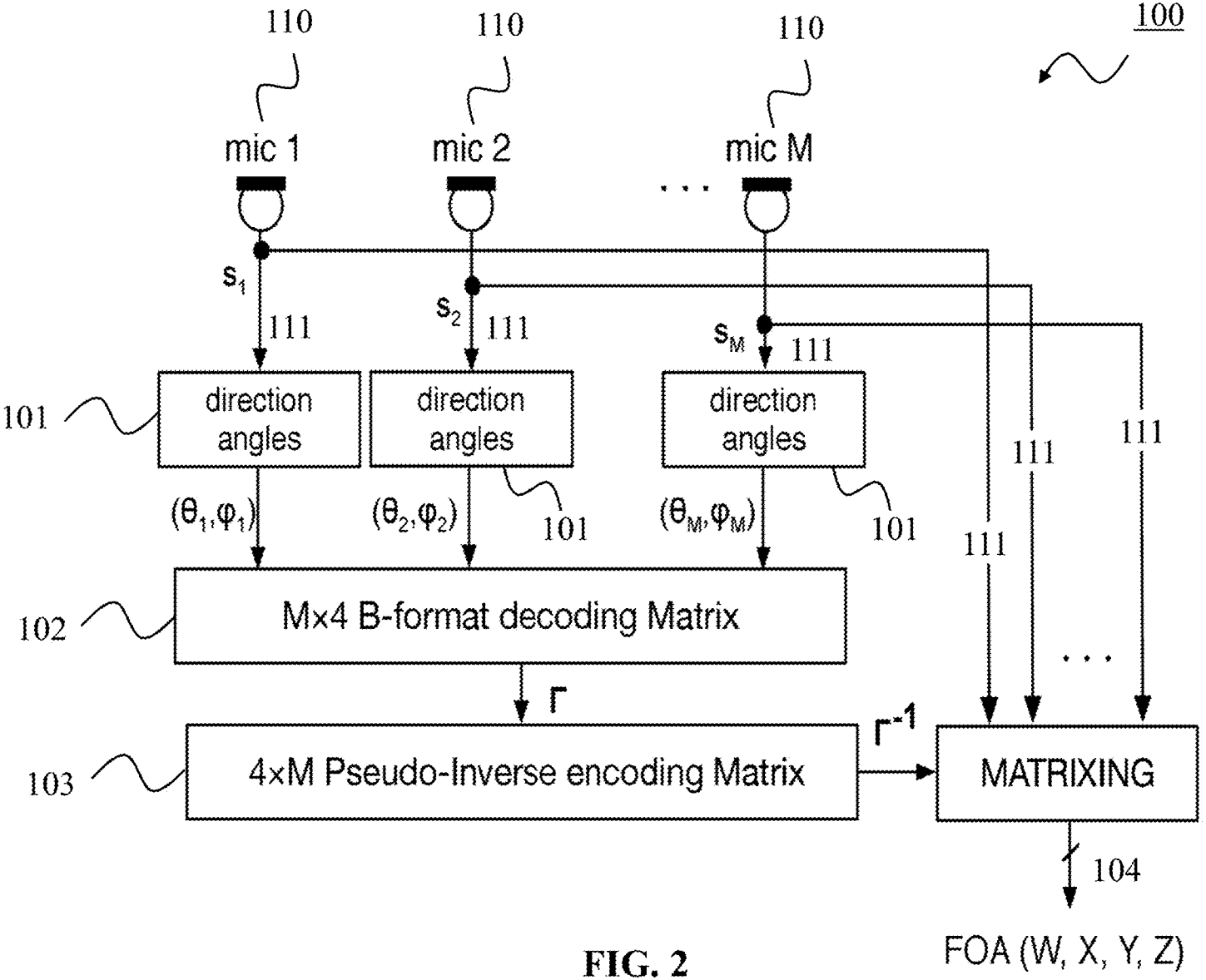
FIG. 2 shows a device for obtaining a FOA signal from signals of at least four directive microphones according to an embodiment of the disclosure.

FIG. 2 shows a device 100 according to an embodiment of the disclosure, which builds on the device 100 shown in FIG. 1. Same elements in FIG. 1 and FIG. 2 are labelled with the same reference signs and function likewise.

The device 100 shown in FIG. 2 may in particular receive signals 111 from more than four (e.g. M=5, M=6, M=5-10, M>10, or even M>20) directive (potentially virtual or first-order) directive microphones 110. In FIG. 2, the device 100 is further shown to include the multiple directive microphones 110. As shown further in FIG. 2, the look direction 101 of a microphone 110 may be based on an azimuth angle and an elevation angle of that microphone 110. Further, the decoding matrix 102 may specifically be a B-format decoding matrix (e.g. an M×4 matrix). The encoding matrix 103 may be a pseudo-inverse encoding matrix (e.g. a 4×M matrix). The encoding of the signals 111 may be performed by matrixing the signals 111 with the encoding matrix 103, in order to obtain the FOA signal 104. The FOA signal 104 may comprises four FOA channels (W, X, Y, Z).

The functions carried out by the device 100 shown in FIG. 2 are now further explained. Considered are generally M first-order microphones 110, which are distributed in the XYZ-space with their coordinates:

$$(x_1,y_1,z_1), (x_2,y_2,z_2), \ldots (x_M,y_M,z_M)$$

Their look directions 101 may be defined by their azimuth (Θ) and elevation (φ) angles. The look direction 101 may in particular be retrieved by using:

If considering directly the $m^{th}$ directive microphone 110:

$$\Theta_m = \arctan\frac{y_m}{x_m}, \tag{2}$$

$$\varphi_m = \arctan\frac{z_m}{\sqrt{x_m^2 + y_m^2}}, \tag{3}$$

If considering omnidirectional microphones, pairing them, for instance, considering a pair of omnidirectional microphones i and j to derive the $m^{th}$ virtual first-order directive microphone 110:

$$\Theta_m = \arctan\frac{y_j - y_i}{x_j - x_i}, \tag{4}$$

and $$\varphi_m = \arctan\frac{z_j - z_i}{\sqrt{(x_j - x_i)^2 + (y_j - y_i)^2}}, \tag{5}$$

Given the look directions 101 of the (potentially virtual) directive microphones 110, a corresponding M×4 matrix Γ (the decoding matrix 102) may be obtained, wherein the matrix would enable to retrieve the M microphone signals 111 from the FOA channels (W, X, Y, Z) by:

$$s = \begin{bmatrix} s_1 \\ s_2 \\ \vdots \\ s_M \end{bmatrix} = \Gamma b \text{ with } b = \begin{bmatrix} W \\ X \\ Y \\ Z \end{bmatrix}, \tag{6}$$

The matrix may be:

$$\Gamma = \begin{bmatrix} u & (1-u)\cos\theta_1\cos\phi_1 & (1-u)\sin\theta_1\cos\phi_1 & (1-u)\sin\phi_1 \\ u & (1-u)\cos\theta_2\cos\phi_2 & (1-i)\sin\theta_2\cos\phi_2 & (1-u)\sin\phi_2 \\ \vdots & \vdots & \vdots & \vdots \\ u & (1-u)\cos\theta_M\cos\phi_M & (1-u)\sin\theta_M\cos\phi_M & (1-u)\sin\phi_M \end{bmatrix} \quad (7)$$

Thereby, u is the first-order microphone directional response characteristic, i.e.:

u<½ sub-cardioid u=½ cardioid u=⅓ super-cardioid u=¼ hyper-cardioid u=0.0 dipole The decoding matrix Γ is then inverted, for example, by using a pseudo-inverse algorithm. The resulting 4×M matrix $\Gamma^{-1}$ (the encoding matrix 103):

$$b=\Gamma^{-1}\cdot s, \quad (8)$$

The pseudo-inverse is the generalized inverse of a matrix. It corresponds to solving the overdetermined linear system of the equations (6). It has 0, 1, or infinitely many solutions. The equation (8) is the closest solution when none exists in the norm 2 sense, i.e. minimizing $|\Gamma b-s|_2$. It gives the single answer when one solution exists. And when many exist, it is the smallest solution in the sense that $|b|_2$ is smallest.

The encoding matrix 103 can then be directly used to encode the directive microphone signals 111 ($s_1, s_2, \ldots, s_M$) into the FOA signal 104. It is also possible to capture/receive microphone signals 111 over time and obtain multiple successive FOA signals.

Given the four encoded FOA channels of the FOA signal 104, a DOA estimation can be performed based on the FOA signal 104 by:

$$\Theta_{DOA} = \arctan\frac{Y}{X}, \quad (9)$$

and $$\varphi_{DOA} = \arctan\frac{Z}{\sqrt{X^2+Y^2}}, \quad (10)$$

The proposed device 100 according to an embodiment of the disclosure, e.g. as shown in FIG. 1 or FIG. 2, can achieve an improved 3D audio recording, and particular the following advantages:

In case of an overdetermined system (M>4) it can exploit the variety of directions (and possibly spacing for omnidirectional pairs) of microphones 110, and thus obtain very accurate results (FOA signal 104).

Its encoding is more robust, and in particular over a larger frequency bandwidth and over a larger set of directions.

It is fully backwards compatible with existing FOA decoders.

Figure 3:
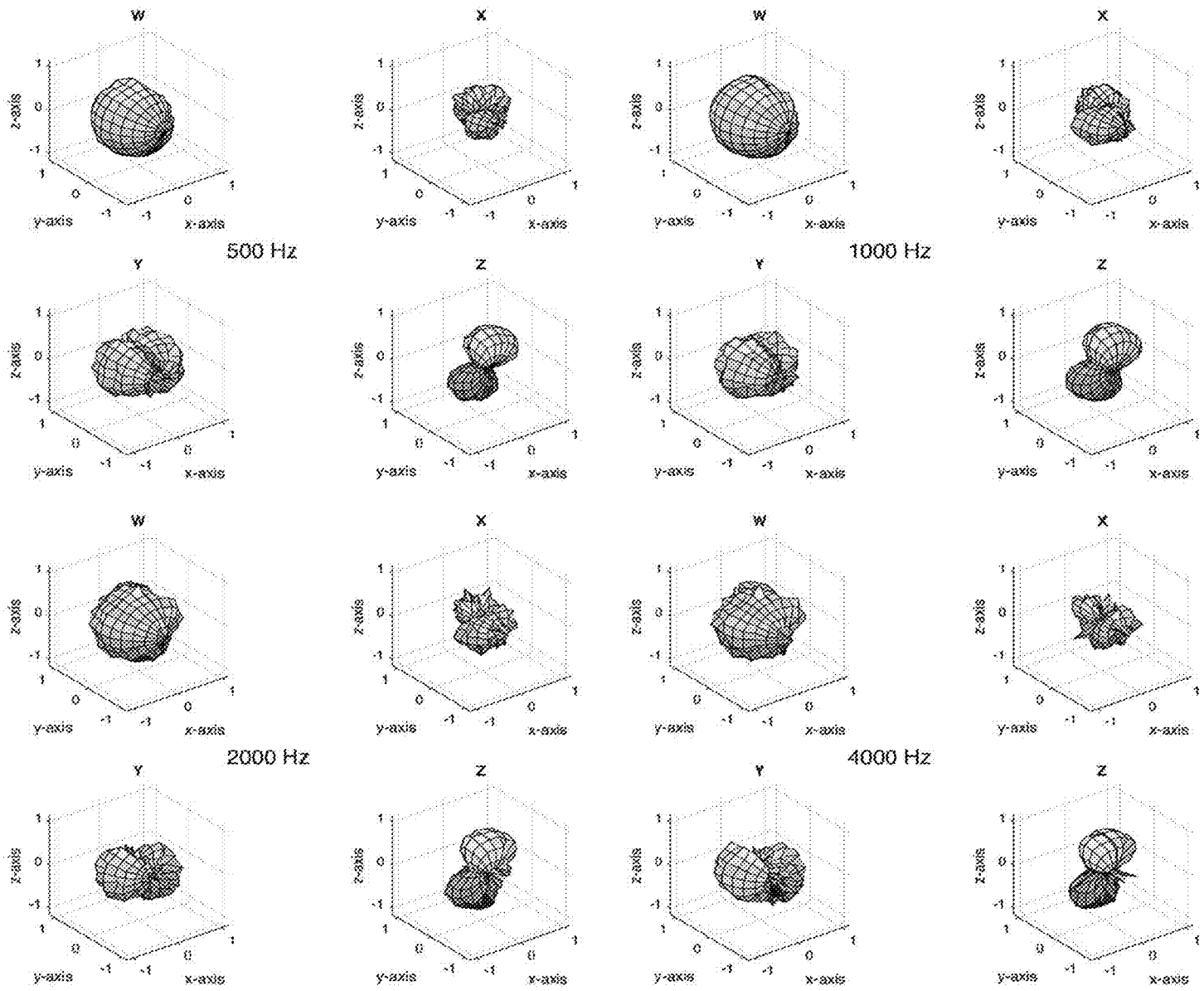
FIG. 3 shows measured directional responses of a FOA signal provided by a device according to an embodiment of the disclosure, using 10 microphone pairs

As shown in FIG. 3, the resulting directional responses of the FOA channels (W, X, Y, Z) have been measured using a phone prototype (including/being a device 100 according to an embodiment of the disclosure) with 5 omnidirectional microphone capsules. Using these 5 microphones, up to 10 pairs can be formed leading to M=10 virtual cardioid signals composing the A format ($s_1, s_2, \ldots, s_{10}$), and thus yielding an overdetermined system. FIG. 3 shows these directional responses for various octave bands.

Figure 4:
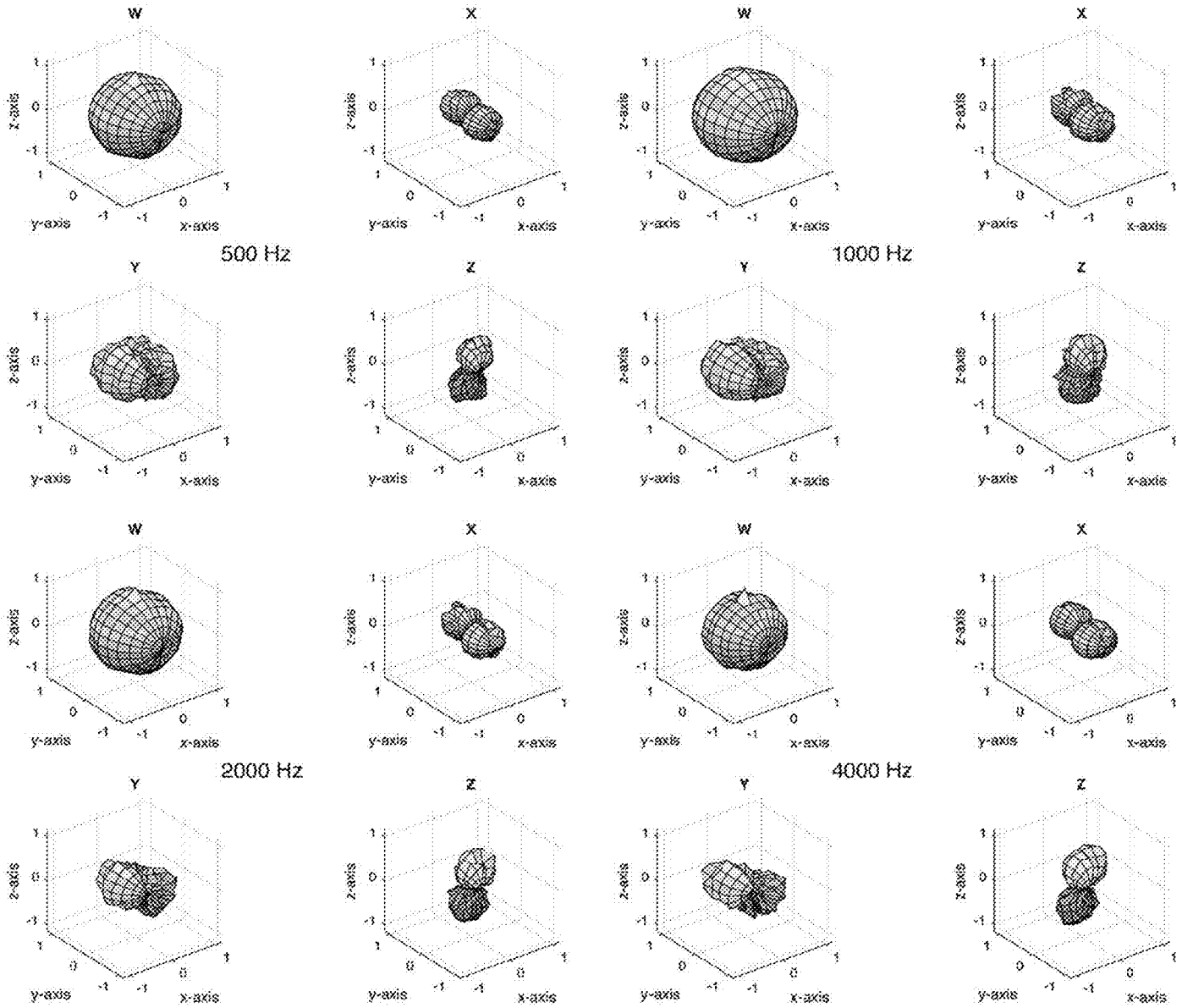
FIG. 4 shows measured directional responses of a FOA signal by a device according to an embodiment of the disclosure, using 4 microphone pairs.

FIG. 4 shows the directional responses using the minimum number of microphone pair (M=4) in a device 100 according to an embodiment of the disclosure. The results shown in FIG. 4 are thus not from an overdetermined system. This leads to somewhat less accurate directional responses compared to FIG. 3.

Figure 5:
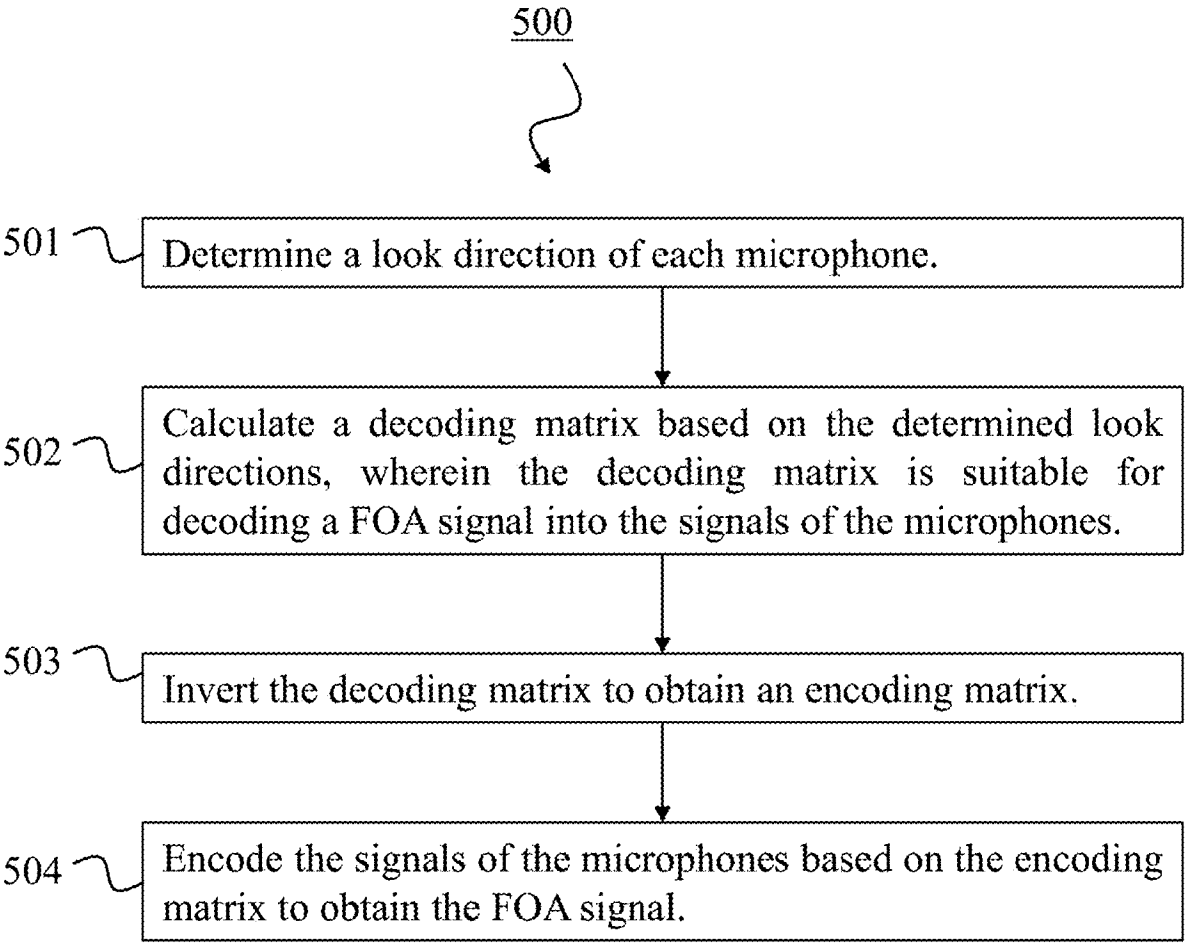
FIG. 5 shows a method for obtaining a FOA signal from signals of at least four directive microphones according to an embodiment of the disclosure.

FIG. 5 shows a method 500 according to an embodiment of the disclosure. The method 500 is suitable for obtaining a FOA signal 104 from signals 111 of at least four, particularly at least five, directive microphones 110. The method 500 may be carried out by the device 100 shown in FIG. 1 or FIG. 2, or may be carried out by a mobile device including such a device 100.

The method 500 comprises: a step 501 of determining 501 a look direction 101 of each microphone 110; a step 502 of calculating a decoding matrix 102 based on the determined look directions 101, wherein the decoding matrix 102 is suitable for decoding a FOA signal into the signals 111 of the microphones 110; a step 503 of inverting the decoding matrix 102 to obtain an encoding matrix 103; and a step 503 of encoding 504 the signals 111 of the microphones 110 based on the encoding matrix 103 to obtain the FOA signal 104.

The present disclosure has been described in conjunction with various embodiments as examples as well as implementations. However, other variations can be understood and effected by those persons skilled in the art and practicing the claimed invention, from the studies of the drawings, this disclosure and the independent claims. In the claims as well as in the description, the word "comprising" does not exclude other elements or steps and the indefinite article "a" or "an" does not exclude a plurality. A single element or other unit may fulfill the functions of several entities or items recited in the claims. The mere fact that certain measures are recited in the mutual different dependent claims does not indicate that a combination of these measures cannot be used in an advantageous implementation.

What is claimed is:

1. A device for obtaining a first order ambisonic (FOA) signal from signals of at least four directive microphones, the device being configured to:

determine look directions of the microphones;

calculate a decoding matrix based on the determined look directions, wherein the decoding matrix is suitable for decoding the FOA signal into the signals of the microphones;

invert the decoding matrix to obtain an encoding matrix; and encode the signals of the microphones based on the encoding matrix to obtain the FOA signal.

2. The device according to claim 1, wherein:

the at least four directive microphones comprise at least five directive microphones.

3. The device according to claim 1, wherein:

the device-comprises the at least four directive microphones.

4. The device according to claim 3, wherein the at least four directive microphones are first-order directive microphones.

5. The device according to one of the claim 1, wherein:

at least one of the microphones is a virtual directive microphone based on at least two omnidirectional microphones.

6. The device according to claim 5, the device configured to:

determine the respective one of the look directions corresponding to the virtual directive microphone based on an orientation of the at least two omnidirectional microphones.

7. The device according to claim 1, wherein:

a respective look direction, of the look directions, of a respective microphone, of the microphones, is based on an azimuth angle and an elevation angle of the respective microphone.

8. The device according to claim 1, wherein:

the decoding matrix is a B-format decoding matrix.

9. The device according to claim 1, the device configured to:

invert the decoding matrix using a pseudo-inverse algorithm.

10. The device according to one of the claim 1, the device configured to:

perform a direction of arrival (DOA) estimation based on the FOA signal.

11. The device according to claim 1, wherein:

the FOA signal comprises four FOA channels.

12. The device according to claim 1, wherein:

the device is a mobile device.

13. A mobile device, configured as a smartphone, a tablet or a camera, which compress the device according to claim 1.

14. A method for obtaining a first order ambisonic (FOA) signal from signals of at least four directive microphones, the method comprising:

determining look directions of the microphones, calculating a decoding matrix based on the determined look directions, wherein the decoding matrix is suitable for decoding the FOA signal into the signals of the microphones, inverting the decoding matrix to obtain an encoding matrix, and encoding the signals of the microphones based on the encoding matrix to obtain the FOA signal.

15. The method according to claim 14, wherein:

the method is performed by a mobile device.

16. A non-transitory computer readable storage medium comprising a program code for carrying out, when executed on a processor, the method according to claim 14.

* * * * *